US005080859A

United States Patent [19]

Abodishish et al.

[11] Patent Number: 5,080,859

[45] Date of Patent: Jan. 14, 1992

[54] PROCESS FOR HARDENING SPONGE REFRACTORY METALS AND PRESSING TO FORM A SHAPE

[75] Inventors: Hani A. M. Abodishish; Randall W. Wahlquist, both of Ogden, Utah

[73] Assignee: Westinghouse Electric Corp., Pittsburgh, Pa.

[21] Appl. No.: 532,301

[22] Filed: Jun. 1, 1990

[51] Int. Cl.[5] ..... C22B 34/14

[52] U.S. Cl. ..... 419/62; 419/66; 75/612; 75/618

[58] Field of Search ..... 75/611, 614–618, 75/612; 419/61, 62, 66

[56] References Cited

U.S. PATENT DOCUMENTS 4,749,409 6/1988 Ishizuka ..... 75/618

FOREIGN PATENT DOCUMENTS 52608 4/1979 Japan ..... 75/618

*Primary Examiner*—Melvyn J. Andrews

*Attorney, Agent, or Firm*—J. C. Valentine

[57] ABSTRACT

A process for hardening sponge refractory metal and making it more susceptible to crushing by the addition of oxygen and/or nitrogen gas to either the reduction stage of the production of the metal from a tetrachloride thereof with magnesium, or to the treatment of a regulus of such metal following vacuum distillation thereof.

11 Claims, No Drawings

PROCESS FOR HARDENING SPONGE REFRACTORY METALS AND PRESSING TO FORM A SHAPE

BACKGROUND OF THE INVENTION

1. Field of the Invention

The invention is in he field of the production fo sponge refractory metals such as zirconium and/or hafnium and titanium and is particularly concerned with relatively impure sponge metal, such as zirconium from which accompanying hafnium values have not been separated, as used for example for ordance purposes rather than for nuclear purposes.

2. Description of the Prior Art

Sponge metals of the type concerned are normally crushed and screened to obtain particles that will effectively adhere together under pressure to provide a sponge metal compact. For this purpose, it is desirable that the sponge metal crush easily to provide a maximum quantity of particles of the right size for compaction into coherent pressed shapes.

SUMMARY OF THE INVENTION

We have found that sponge refractory metals will crush more easily into particles that will adhere together more effectively under compaction if the metal is made more brittle by hardening, and have found that this can be accomplished by the controlled injection of nitrogen and/or oxygen gas into the inert atmosphere maintained during normal reduction of the tetrachloride in the production of the sponge metal or into a similar inert atmosphere provided in the usual vacuum distillation furnace following the normal distillation cycle.

DETAILED DESCRIPTION OF THE BEST MODE CONTEMPLATED

The best mode presently contemplated for carrying out the invention is to inject nitrogen and/or oxygen gas into the inert, e.g. helium or argon, atmosphere normally maintained during reduction of a charge of a tetrchloride of the metal with magnesium metal in a conventional reduction furance during production of the sponge metal. This insures the desired hardening throughout the entire body of the sponge metal product.

For exmaple, in accordance with usual practice, zirconium-hafnium sponge metal contains oxygen in the range of about 500 to about 900 parts per million and less than about 30 parts per million of nitrogen. This low level of oxygen and ntirogen results in a low level Brenell hardness, i.e. in a range between about 105 and 115. With such a low level of Brenell hardness, it is very difficult to produce sponge metal fines of the character required for compaction into various shapes, e.g. for ordance purposes, and the fines that are obtained for this purpose require the application of excessive force for compaction to achieve and maintain required tensile strength of the prodcut. This is due to the higher bulk density of relatively soft sponge as compared with harder sponge. The amount of such soft sponge, in terms of weight, required for a given compact shape is ordinarily in the range of form 15% to 20% greater than it would be for a sponge that is significantly harder.

We have found that if a sufficient amount of a mixture of gaseous oxygen and/or nitrogen is introduced into the reduction furnace with the helium or argon gas normally maintained as an inert atmosphere in such furnace, oxygen and/or nitrogen compounds will be formed at the reaction temperature normally maintained in such a furnace (about 500° C.), which will be distributed throughout the resulting sponge metal product to provide an oxygen content in the range of about 4000 to about 5000 ppm and nitrogen content in the range of about 800 to about 1000 ppm. This will raise the normal average Brinell hardness of such sponge metal product (ranging from about 105 to about 115) to an average Brinell hardness ranging from about 250 to about 350.

Although similar hardening of the sponge metal product can be carried out following the usual distillation cycle in the conventional vacuum distillation furnace, a difficulty is encountered in that the large size of this regulus of sponge metal produced during the reduction stage means that only an outer shell of the regulus is hardened and made brittle, while internally the regulus remains without benefit of the hardeining treatment. Accordingly, this aspect of the invention is indicated only in special situations.

EXAMPLE no. 1

A mixture of 3 standard cubic feet per hour (scfh) of gaseous oxygen and 2 scfh of gaseous ntirogen was introduced along with50 schf of the usual argon gas into a conventional reduction furnace during a usual run of such furnace on a charge of 7000 lbs. of crude zirconium tetrachloride powder and 1960 lbs. of magnesium metal at a temperature of from about 850° C. to about 1000° C. over a period of about ten hours throughout the active period of the reaction, followed by a vacuum distillation cycle carried out as usual in a conventional vacuum distillation furnace.

It is believed that the following reactions tool place in the reduction furnace prior to reaction of the tetrachloride and the magnesium:

$$ZrCl_4 \cdot \tfrac{1}{2}O_2 \rightarrow ZrOCl_2 \cdot 2Cl$$

$$ZrOCl_2 + \tfrac{1}{2}O_2 \rightarrow ZrO_2 + 2Cl$$

$$ZrCl_4 + N \rightarrow ZrN + 4Cl$$

and that the $ZrO_2$ and ZrN were distributed throughout the tetrachloride without further reaction.

It was found that Brinell hardness of the sponge metal product averaged 280 and that oxygen content was 7800 ppm and nitrogen content was 980 ppm.

This relatively hard crude zirconium sponge metal product was unusually brittle throughout and crushed exceptionally well. The resulting sponge metal fines compacted under less weight than normal.

EXAMPLE NO. 2

A zirconium-hafnium sponge regulus of size approximately six feet in diameter by one and a half feet long, produced by reduction of a crude zirconium tetrachloride in the normal way, was passed through the usual distillation furnace to remove magnesium and magnesium chloride and was treated thereafter in the same furnace by shutting off the vacuum, reducing furnace temperature to approximately 950° C., and pumping into the furnace a mixture of 85% argon, 10% oxygen, and 5% nitrogen gases and leaving such mixture of gases in the furnace over a period of eight hours. The product regulus was found to have been appropriately hardened to a depth of only about 2 to 3 inches from the surface, leaving the remaining interior portion unaffected.

Although pure zirconium sponge may be treated in the same way as that produced from the crude tetrachloride, it is normally not indicated since the addition of oxygen and/or nitrogen is not appropriate for the nuclear uses of the pure zirconium metal.

Even though the above examples were carried out using both oxygen and nitrogen gases, we have found experimentally in the laboratory that either if used alone will also effect desired hardening of the sponge metal.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim as my invention:

1. A process for producing an unusually brittle sponge refractory metal for easier crushing and for more effective compacting of the resulting sponge metal fragments into pressed shapes, comprising: introducing an effective amount of one or more gases selected from the group consisting of oxygen and nitrogen, along with an inert gas, into a furnace containing a sponge refractory metal charge while the furnace is operating on said charge to produce refractory metal having a Brinell Hardness Number of from about 250 to about 350.

2. A process according to claim 1, wherein the furnace is a reducing furnace and is operating to reduce a charge of a tetrachloride of the metal with magnesium to produce a sponge metal regulus.

3. A process according to claim 1, wherein the furnace is a vacuum distillation furnace; comprising the further step of vacuum distilling the sponge metal charge in said vacuum distillation furnace before introducing the selected gas or gases with the inert gas into the distillation furnace.

4. A process according to claim 1, wherein boty oxygen and nitrogen gases are introduced into the furnace to raise the Brinell hardness of the contacted sponge metal to within a range of about 250 to about 350.

5. The process according to claim 1, wherein the selected gas is present in the inert gas in an amount effective to produce a sponge refractory metal containing about 4000 to about 5000 ppm oxygen and about 800 to about 1000 ppm nitrogen.

6. The process according to claim 1, wherein the selected gas is present in the inert gas in an amount effective to produce a sponge refractory metal containing about 7800 ppm oxygen and about 980 ppm nitrogen.

7. The process according to claim 1, including the further setp of maintaining the sponge refractory metal charge at a temperature of at least about 500° C. while it is exposed to the selected gas or gases.

8. A process for producing a refractory metal shape, comprising the steps of:

maintaining a refractory metal sponge in a furnace atmosphere containing an amount of gas selected from the group consisting of oxygen and nitrogen sufficient to produce refractory metal having a Brinell Hardness Number of from about 250 to about 350;

crushing the sponge to form sponge metal fragments; and pressing the sponge metal fragments to form a shape.

9. The process according to claim 8, wherein a zirconium sponge is maintained at a temperature of at least about 500° C. in a furnace atmosphere containing an amount of oxygen and nitrogen sufficient to produce sponge metal containing about 7800 ppm oxygen and about 980 ppm nitrogen.

10., The process according to claim 8, wherein a zirconium sponge is maintained at a temperature of at least about 500° C. in a furnace atmosphere containing an amount of selected gas or gases sufficient to produce sponge metal having a Brinell Hardness Number of about 280.

11. The process according to claim 8, wherein a zirconium sponge is maintained at a temperature of at least about 500° C. in an argon atmosphere containing from about 5% to about 10% oxygen and from about 3% to about 5% nitrogen.

* * * * *